US011130607B2

(12) United States Patent
Hasegawa et al.

(10) Patent No.: US 11,130,607 B2
(45) Date of Patent: Sep. 28, 2021

(54) BOTTLE CAN, BOTTLE CAN WITH CAP, AND METHOD FOR MANUFACTURING BOTTLE CAN

(71) Applicant: TOYO SEIKAN CO., LTD., Tokyo (JP)

(72) Inventors: Toshiyuki Hasegawa, Kanagawa (JP); Masaomi Tamura, Tokyo (JP); Tomohiko Nakamura, Kanagawa (JP); Nobuhiro Sasajima, Kanagawa (JP); Takeshi Murase, Kanagawa (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 24 days.

(21) Appl. No.: 16/614,102

(22) PCT Filed: May 2, 2018

(86) PCT No.: PCT/JP2018/017507
§ 371 (c)(1),
(2) Date: Nov. 15, 2019

(87) PCT Pub. No.: WO2018/211993
PCT Pub. Date: Nov. 22, 2018

(65) Prior Publication Data

US 2020/0172282 A1 Jun. 4, 2020

(30) Foreign Application Priority Data

May 19, 2017 (JP) ..... JP2017-099482

(51) Int. Cl.
*B65D 1/02* (2006.01)
*B21D 51/26* (2006.01)
*B65D 41/04* (2006.01)

(52) U.S. Cl.
CPC ..... *B65D 1/0246* (2013.01); *B21D 51/26* (2013.01); *B65D 41/0407* (2013.01)

(58) Field of Classification Search
CPC .... B65D 1/0246; B65D 1/023; B65D 1/0223; B65D 41/0407; B65D 41/04;
(Continued)

(56) References Cited

U.S. PATENT DOCUMENTS 2,864,528 A * 12/1958 Henchert ..... B21D 51/2623 220/806
4,856,667 A 8/1989 Thompson
(Continued)

FOREIGN PATENT DOCUMENTS

CN 102616421 8/2012
DE 0 549 987 A1 7/1993
(Continued)

OTHER PUBLICATIONS

Office Action dated Jul. 31, 2020 in Chinese Patent Application No. 201880032978.2 and English translation thereof.
(Continued)

*Primary Examiner* — Robert J Hicks
(74) *Attorney, Agent, or Firm* — Greenblum & Bernstein, P.L.C.

(57) ABSTRACT

The present application improves the shape of a curl part of a bottle can to secure high sealability even under high pressure in the can and during heat sterilization, makes bubbling-over occur less during cap opening, and suppresses misrecognition of reseal.
A bottle can has a curl part provided at an opening end of a mouth part. The curl part includes an outer wall part extending downward from an upper end bent part. The outer wall part includes a first bent part shaping a locking part that extends continuously and downwardly from the upper end
(Continued)

bent part and shapes an outwardly-protruding convex, and a second bent part that extends continuously and downwardly from the first bent part and shapes an inwardly-protruding convex.

18 Claims, 7 Drawing Sheets

(58) Field of Classification Search
CPC ..... B65D 41/0421; B65D 41/0435; B21D 51/26; B21D 51/2638; B21D 51/2623; B21D 51/2615
USPC ..... 215/44, 43, 329, 344, 343, 341, 316; 220/304, 288; 72/379.4
See application file for complete search history.

(56) References Cited

U.S. PATENT DOCUMENTS

| | | | | |
|---|---|---|---|---|
| 6,010,026 | A * | 1/2000 | Diekhoff | B21D 51/26 215/335 |
| 6,959,830 | B1 | 11/2005 | Kanou et al. | |
| 7,171,840 | B2 | 2/2007 | Kanou | |
| 8,689,990 | B2 | 4/2014 | Hdeyasu | |
| 2012/0024813 | A1* | 2/2012 | Nakagawa | B65D 1/0246 215/40 |
| 2012/0269602 | A1 | 10/2012 | Hanafusa et al. | |
| 2013/0056436 | A1 | 3/2013 | Muto et al. | |

FOREIGN PATENT DOCUMENTS

| | | | |
|---|---|---|---|
| EP | 2 500 292 | A1 | 9/2012 |
| ES | 1 071 736 | U | 3/2010 |
| JP | 08-047970 | A | 2/1996 |
| JP | 2001-213417 | | 8/2001 |
| JP | 2003-237752 | A | 8/2003 |
| JP | 2003-321019 | A | 11/2003 |
| JP | 2004-175386 | | 6/2004 |
| JP | 2004-217305 | | 8/2004 |
| JP | 2009-148777 | A | 7/2009 |
| JP | 2009-196679 | | 9/2009 |
| JP | 2011-240937 | | 12/2011 |
| JP | 2015-3325 | | 1/2015 |
| JP | 2018-127272 | A | 8/2018 |

OTHER PUBLICATIONS

Official Communication issued in International Patent Application No. PCT/JP2018/017507, dated Jul. 17, 2018 and English language translation thereof.
Office Action issued in Taiwan Counterpart Patent Appl. No. I669247, dated Feb. 22, 2019, along with an English translation thereof.
Extended European Search issued in European Patent Application No. 18802291.7 dated Feb. 3, 2021.
Office Action issued in Korean Patent Application No. 10-2019-7036825 dated May 17, 2021, along with English Translation thereof.
Office Action issued in corresponding Chinese Patent Application No. 201880032978.2 dated Apr. 2, 2021, and English Translation thereof.
Office Action issued in corresponding Japanese Patent Application No. 2018-172742 dated Apr. 6, 2021, and English Translation thereof.

* cited by examiner (a)

(b)

(b)

(a)

BOTTLE CAN, BOTTLE CAN WITH CAP, AND METHOD FOR MANUFACTURING BOTTLE CAN

TECHNICAL FIELD

The present invention relates to a bottle can, a bottle can with a cap, and a method for manufacturing the bottle can.

BACKGROUND ART

In the manufacturing of bottle cans, a metal plate made of aluminum or its alloy is subjected to drawing processing and ironing processing to obtain a bottomed cylindrical form body, and thereafter an opened mouth part is subjected to neck form processing to shape a shoulder part and a mouth part. The mouth part is further subjected to screw form processing, and a curl part is shaped at an opening end of the mouth part by curl form processing.

For the curl part shaped at the mouth part of the can body, various processing shapes have been proposed in consideration of sealability between the curl part and a cap sealing material which is to be adhered to the mouth part.

For example, the conventional technology disclosed in PTL 1 indicates that a curl part shaped by folding the rim of an opened mouth part radially outward has an outer face side wall part extending in a direction substantially parallel to a can axis direction of a bottle can, an outer side convex curved part directed radially inward from an upper end of the outer face side wall part, and an inner side convex curved part directed further radially inward from the outer side convex curved part, and the outer face side wall part has a predetermined length or longer, and a connecting part between the outer face side wall part formed into a linear shape by crushing processing and the outer side convex curved part is separated away from the upper end of the bottle can (the upper end of the mouth part).

CITATION LIST

Patent Literature

[PTL 1] Japanese Patent Application Publication No. 2004-217305

SUMMARY OF INVENTION

Technical Problem

In the above-mentioned conventional technology, the connecting part between the outer face side wall part and the outer side convex curved part at the curl part is separated away from the upper end of the bottle can, so that the sealability of a bottle can with a cap in which a cap having liner material on its inner surface is adhered is secured, with the above-mentioned connecting part being a seal point.

In the conventional technology, however, if the pressure in a bottle can with a cap filled with contents increases, the above-mentioned seal point becomes away from the liner material because the cap floats due to the pressure, and only the outer face side wall part extending in the direction substantially parallel to the can axis direction is in contact with the liner material. In this case, the contact length between the liner material and the outer face side wall part differs depending on conditions of filling temperature of the contents and top load in a capping step, and hence sufficient sealability cannot be secured depending on the conditions.

In particular, when heat sterilization is performed after the can is filled with contents, the pressure in the can may increase during the sterilization and the sealability may decrease according to the above-mentioned conventional technology.

For bottle cans with cap, it is common practice to fill a head space in the can with liquid nitrogen in order to thin the can while the pressure in the can for non-carbonated beverage is positive pressure. The head space in the can is pressurized by nitrogen. If the contents in the can become bubbled when, for example, the bottle can with cap filled with contents is shaken, a problem in that bubbled contents may flow out during cap opening due to the pressure in the can easily occurs. In the above-mentioned conventional technology, the pressure in the can is released to the atmospheric air immediately after cap opening, thus causing a problem in that the above-mentioned bubbling-over easily occurs.

To deal with this, the above-mentioned problem of bubbling-over can be decreased by forming the liner material of the cap into a shape (an undercut shape) wrapping around on the can axis below the curl part. However, if the undercut amount is increased in the undercut shape, when the cap is once opened and resealed, an undercut portion of the liner material becomes resistance to increase reseal torque, and there is a problem in that misrecognition of reseal that the cap has not been sufficiently resealed at the time when a user feels that the reseal is completed. The misrecognition of reseal easily causes an accident that a user lays a bottle can with a cap having contents inside in a bag after the user thought that the can was resealed and the inside of the bag is wetted due to liquid leakage. Thus, the undercut amount of the liner material needs to be controlled to the optimum amount, but it is difficult to stably secure the undercut amount because the undercut amount varies depending on filling temperature of contents, capping conditions, or the like.

The present invention has an object of dealing with such problems. That is, it is an object of the present invention to improve the shape of a curl part of a bottle can to secure high sealability even under high pressure in the can or during heat sterilization, make bubbling-over less occur during cap opening, and suppress misrecognition of reseal.

Solution to Problem

In order to solve the problems, the present invention has the following configuration.

The present invention provides a bottle can provided with a curl part at an opening end of a mouth part, in which the curl part includes an outer wall part extending downward from an upper end bent part, and the outer wall part includes: a first bent part shaping a locking part that extends continuously and downwardly from the upper end bent part and shapes an outwardly-protruding convex; and a second bent part that extends continuously and downwardly from the first bent part and shapes an inwardly-protruding convex.

Advantageous Effects of Invention

According to the present invention having the features described above, the first bent part and the second bent part are provided on the outer wall part of the curl part of the bottle can, whereby an undercut of the liner material can be hooked on the locking part. As a result, high sealability can be secured even under high pressure in the can or during heat sterilization. Furthermore, the undercut of the liner material between the first bent part and the second bent part can make bubbling-over less occur during cap opening. Increase in reseal torque can be suppressed by adjusting the undercut amount by the first bent part and the second bent part to prevent the misrecognition of reseal.

BRIEF DESCRIPTION OF DRAWINGS

FIG. 6 (*b*) is an explanatory diagram showing an example of a form method of forming a curl part and illustrates forming at a second stage.

FIG. 7 (*a*) is front view.

FIG. 7 (*b*) is an explanatory diagram showing a configuration example of an outer tool for performing forming in FIG. 6 (*a*) and FIG. 6 (*b*). FIG. 7 (*b*) is cross-sectional view taken along A-A in FIG. 7 (*a*).

DESCRIPTION OF EMBODIMENTS

Figure 1:
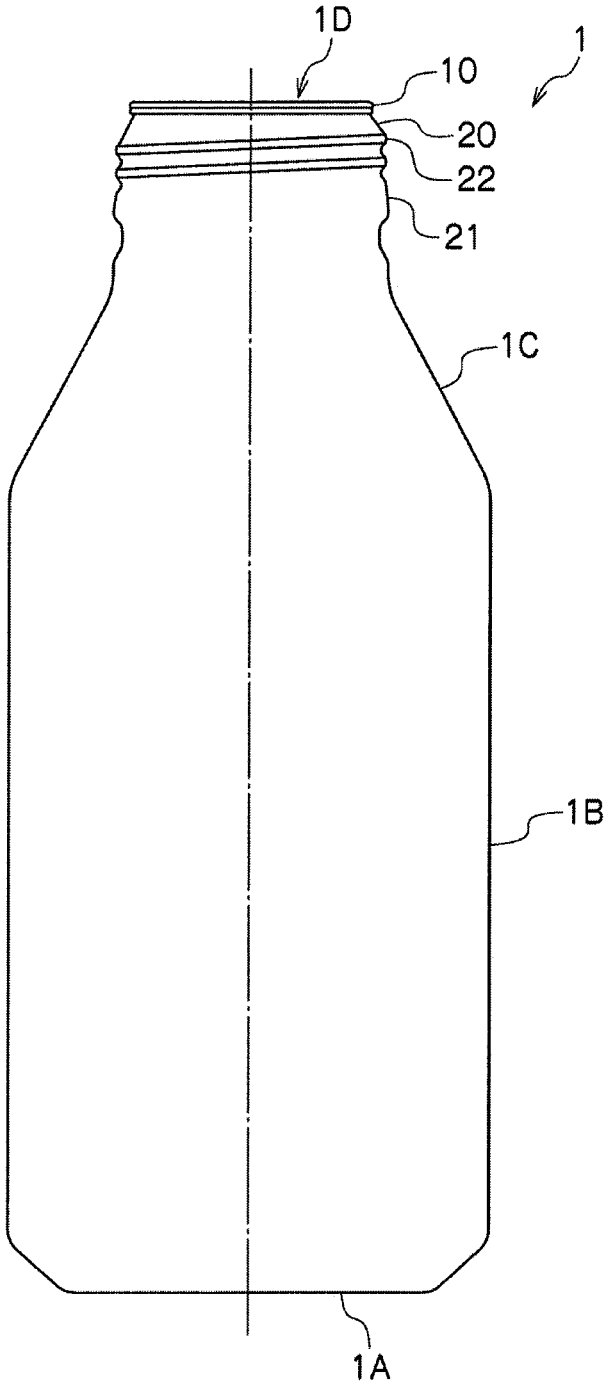
FIG. 1 is an explanatory diagram showing an overall configuration of a bottle can according to an embodiment of the present invention.

Referring to the drawings, embodiments of the present invention will be described below. In the following description, the same reference symbols in different figures denote portions having the same functions, and overlapping descriptions in the figures are omitted as appropriate.

As shown in FIG. 1, a bottle can 1 includes, for example, a bottom part 1A, a body part 1B, a shoulder part 1C, and a mouth part 1D. Such a bottle can 1 is shaped by punching a metal plate made of an aluminum alloy into a circular shape, subjecting the metal plate to drawing processing to obtain a bottomed cylindrical body, and subjecting the bottomed cylindrical body to redrawing processing and ironing processing to temporarily obtain a cylindrical can having a predetermined thickness. After that, neck-in processing is performed to reduce the diameter of the cylindrical can by a predetermined length from an opening end thereof to shape the shoulder part 1C and the mouth part 1D. A skirt part 21 and a screw part 22 are shaped at the mouth part 1D by spinning processing. Then, a neck shoulder part 20 inclined upward and inward is shaped above the screw part 22 by neck-in processing, and a curl part 10 is shaped at an opening end above the neck shoulder part 20.

Figure 2:
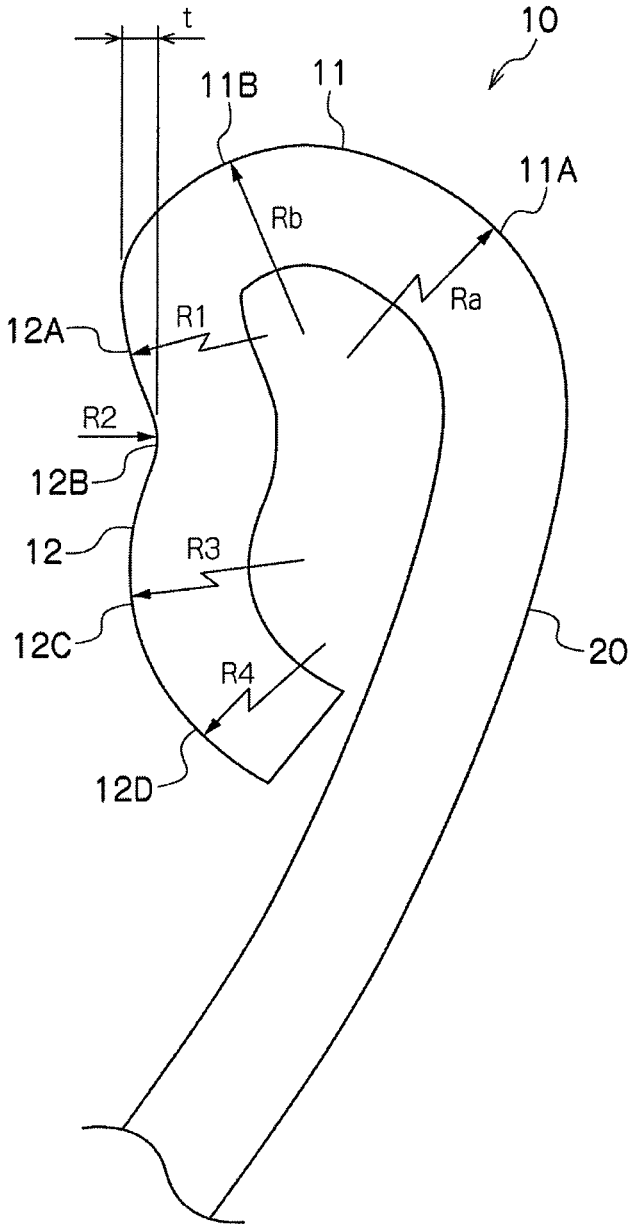
FIG. 2 is an explanatory diagram (cross-sectional diagram) showing a curl part of the bottle can according to the embodiment of the present invention.

The curl part 10 of the bottle can 1 according to an embodiment of the present invention has a cross-sectional shape as shown in FIG. 2. The curl part 10 has an upper end bent part 11 obtained by bending an upper part of the neck shoulder part 20 outward, and has an outer wall part 12 extending downward from the upper end bent part 11. For example, the upper end bent part 11 includes an inner bent part 11A having a radius of curvature of Ra and an outer bent part 11B having a radius of curvature of Rb.

The outer wall part 12 includes at least a first bent part 12A (radius of curvature R1) that extends continuously and downwardly from the upper end bent part 11 and shapes an outwardly-protruding convex, and a second bent part 12B (radius of curvature R2) that extends continuously and downwardly from the first bent part 12A and shapes an inwardly-protruding convex. In the illustrated example, the outer wall part 12 includes a third bent part 12C (radius of curvature R3) that shapes an outwardly-protruding convex and a fourth bent part 12D (radius of curvature R4) that shapes an outwardly-protruding convex in addition to the first bent part 12A and the second bent part 12B.

In the bottle can 1, a locking part (a first locking part) is shaped on the outer wall part 12 of the curl part 10 because the first bent part 12A that shapes an outwardly-protruding convex and the second bent part 12B that shapes an inwardly-protruding convex are provided. The locking part herein refers to a configuration in which a lower part of an object outer surface is constricted to be thinner than an upper part thereof. The bottle can 1 having such a curl part 10 is provided with the above-mentioned locking part (the first locking part), and hence after capping, the liner material of the cap enters the under part of the locking part to shape an undercut (a first undercut), so that the undercut is hooked on the locking part. Thus, the cap can be prevented from floating even when the pressure in the can is high or during heat sterilization, and high sealability can be secured.

Owing to the above-mentioned undercut, the adhesion between the undercut and the locking part is secured even when the cap floats immediately after cap opening, and hence a phenomenon that contents bubbled in the can flow out of the can due to the pressure in the can during cap opening can be prevented.

Further, the outer wall part 12 of the curl part 10 can regulate the undercut amount of liner material owing to the presence of the second bent part 12B, and hence reseal torque can be reduced. Consequently, resistance during reseal can be prevented from excessively increasing due to the undercut, and misrecognition of reseal can be prevented.

It is preferred that a bead depth (difference between outermost part of the first bent part 12A and innermost part of second bent part 12B) "t" shaped by the first bent part 12A and the second bent part 12B be about 0.05 to 0.2 mm. When the bead depth "t" is less than 0.05 mm, the above-mentioned action of the undercut is less easily obtained, and problems of reduction in sealability during heat sterilization and bubbling-over during cap opening easily occur. When the bead depth "t" exceeds 0.2 mm, a gap is easily formed between the liner material and a concave part (bead) formed by the second bent part 12B, and even when the bead depth "t" is increased further, the hooking action of the undercut is not increased.

To obtain the appropriate bead depth "t", it is preferred to set the radius of curvature R1 of the first bent part 12A to 0.5 to 3 mm and the radius of curvature R2 of the second bent part 12B to 0.5 to 2 mm.

A seal point for cap adhesion is the upper end bent part 11, and hence in order to appropriately secure the amount of the upper end bent part 11 that enters the liner material at the seal point, it is preferred to set the radius of curvature Ra of the inner bent part 11A in the upper end bent part 11 to be larger than the radius of curvature Rb of the outer bent part 11B (Ra>Rb), and set Ra to 0.5 to 2 mm and Rb to 0.3 to 0.8 mml.

When Rb is less than 0.3 mm, the entering of the upper end bent part 11 into the liner material is too large, which causes damage of the liner material. When Rb is larger than 0.8 mm, the entering of the upper end bent part 11 into the liner material is decreased, and desired sealability is not obtained at the seal point.

The shape of the upper end bent part 11 has influence on deformation resistance upon drop impact. When Ra is less than 0.5, axial force component increases upon drop impact, and axial deformation of the curl part 10 increases. When Ra exceeds 2 mm, the amount of the upper end bent part 11 entering the liner material decreases, and hence desired sealability is difficult to obtain at the seal point, and the angle of the neck shoulder part 20 is decreased to reduce buckling strength.

As in the illustrated example where the outer wall part 12 of the curl part 10 has the third bent part 12C and the fourth bent part 12D, a locking part (a second locking part) is shaped below the outermost part of the third bent part 12C, and hence by covering the liner material of the cap over the second locking part to shape a second undercut, the above-mentioned sealability under high pressure can be further increased, and the bubbling-over during cap opening can be more reliably suppressed. By providing both the first undercut and the second undercut to increase the sealability, both the undercut amounts can be suppressed, and hence the resistance during sealing can be reduced to more reliably prevent misrecognition of reseal. The third bent part 12C and the fourth bent part 12D may be shaped to have different radii of curvature R or one radius of curvature R. It is preferred to set the radius of curvature R3 of the third bent part 12C and the radius of curvature R4 of the fourth bent part 12D to 0.3 to 2 mm in terms of obtaining the action of the second undercut similarly to the above-mentioned first undercut.

Figure 3:
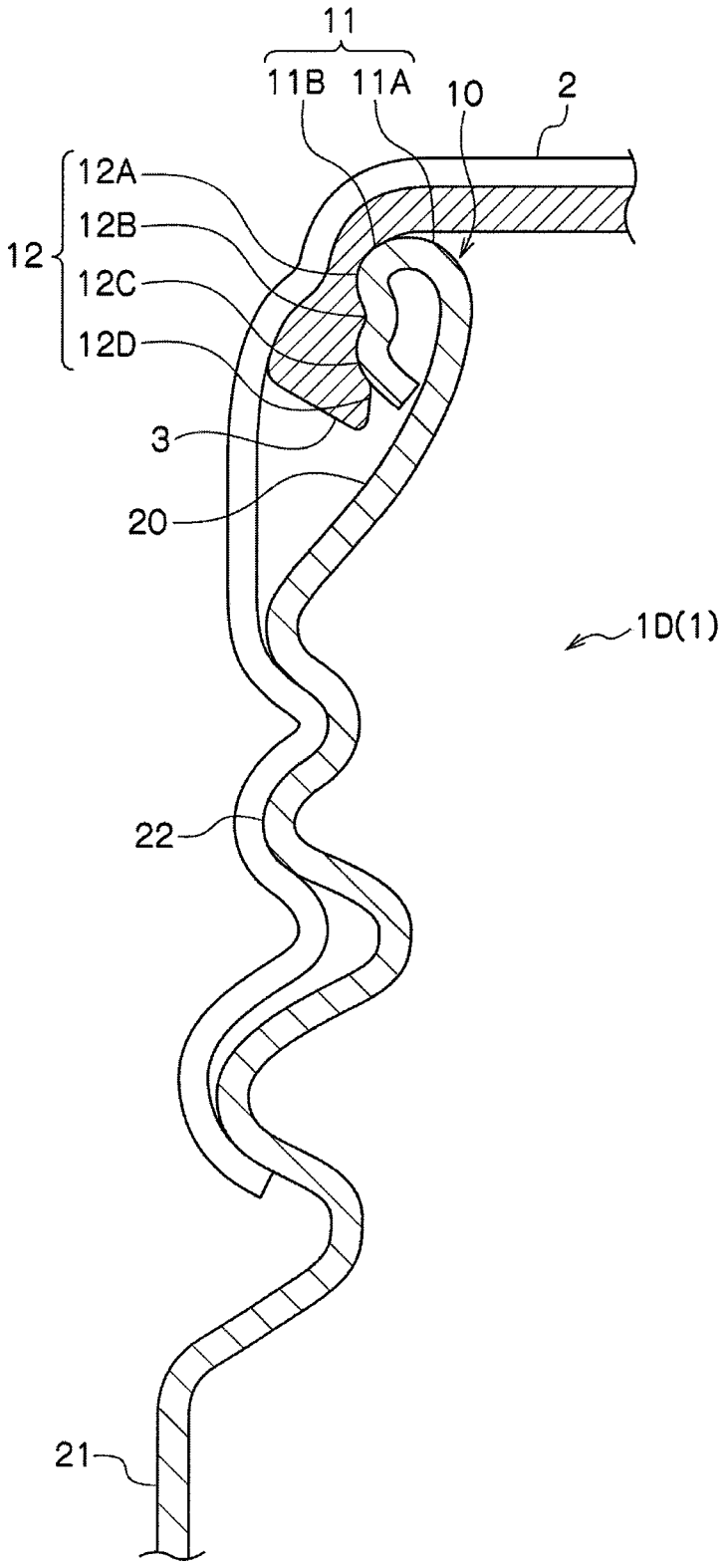
FIG. 3 is an explanatory diagram showing a bottle can with a cap according to the embodiment of the present invention.

FIG. 3 shows a bottle can with a cap. The bottle can with cap has a cap 2 seamed at the mouth part 1D of the bottle can 1. The cap 2 includes a liner material 3 on the inner side of a top part. In the illustrated example, the curl part 10 of the bottle can 1 has the first bent part 12A, the second bent part 12B, the third bent part 12C, and the fourth bent part 12D on the outer wall part 12, and the liner material 3 of the seamed cap 2 is adhered so as to cover the first bent part 12A, the second bent part 12B, the third bent part 12C, and the fourth bent part 12D.

Figure 4:
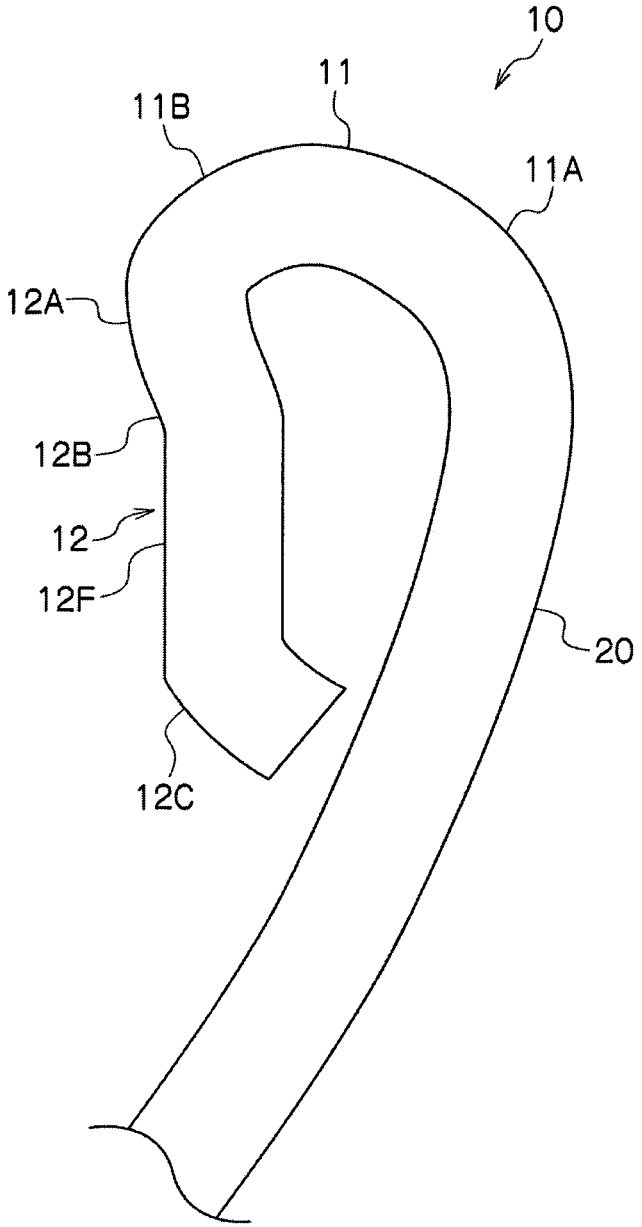
FIG. 4 is an explanatory diagram (cross-sectional diagram) showing a curl part of a bottle can according to another embodiment of the present invention.

FIG. 4 shows another embodiment of the curl part 10. In this example, the curl part 10 includes a flat part 12F between the second bent part 12B and the third bent part 12C of the outer wall part 12. Also in this example, the first locking part is shaped at a portion from the first bent part 12A to the second bent part 12B, and a second locking part is shaped in the third bent part 12C from below the flat part 12F. By providing such a flat part 12F, the undercut amount of the liner material can be adjusted to suppress the increase in reseal torque.

Figure 5:
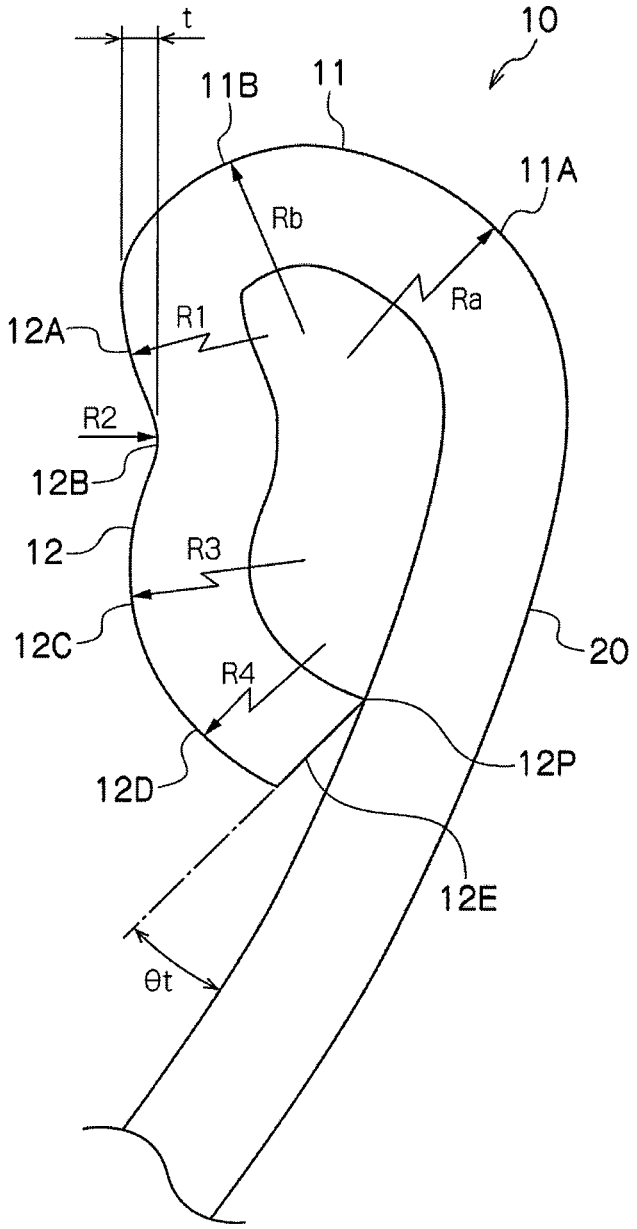
FIG. 5 is an explanatory diagram (cross-sectional diagram) showing a curl part of a bottle can according to another embodiment of the present invention.

FIG. 5 shows another different embodiment of the curl part 10. In this example, a lower end inner edge 12P of the outer wall part 12 is in line contact with the neck shoulder part 20, and an open angle θt is provided between a lower end face 12E of the outer wall part 12 and the neck shoulder part 20. For example, the angle θt is set to an angle of 10° to 70°.

According to this example, the lateral compression rigidity of the curl part 10 is increased by bead formed from the above-mentioned second bent part 12B forming an inwardly-protruding convex, and hence deformation resistance upon drop impact of the curl part 10 can be increased. The lower end inner edge 12P of the outer wall part 12 is brought into contact with the neck shoulder part 20, and the open angle θt is provided between the lower end face 12E of the outer wall part 12 and the neck shoulder part 20, whereby the curl part 10 can be easily deformed so as to be inclined outward when applied with drop impact, and the adhesion with the liner material can be maintained. It is preferred that the contact between the lower end inner edge 12P of the outer wall part 12 and the neck shoulder part 20 be line contact. The effect of maintaining the sealability when the can is upset and dropped after the filling of contents and the capping can be thereby increased.

Figure 6A:
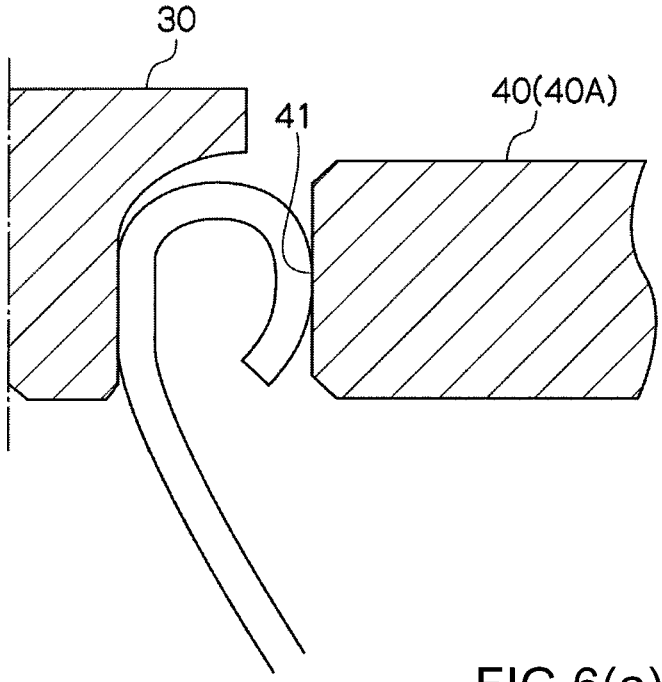
FIG. 6 (*a*) is an explanatory diagram showing an example of a form method of forming a curl part and illustrates forming at a first stage.
Figure 6B:
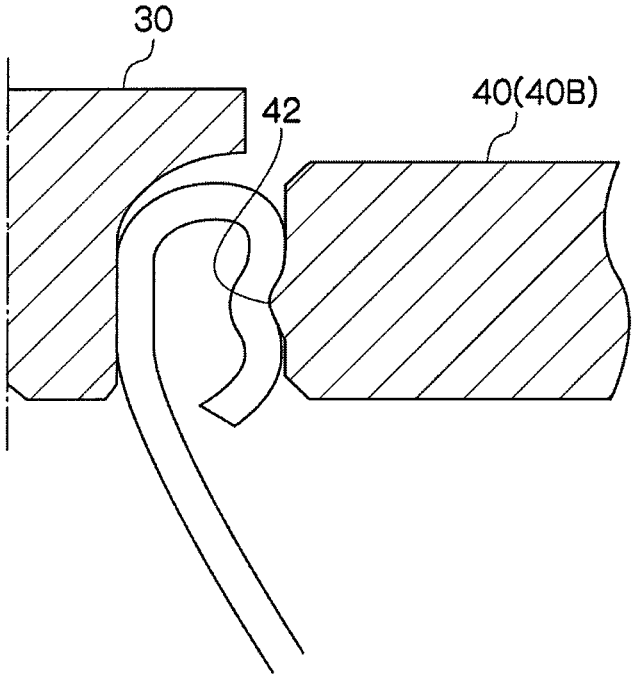
Figure 7B:
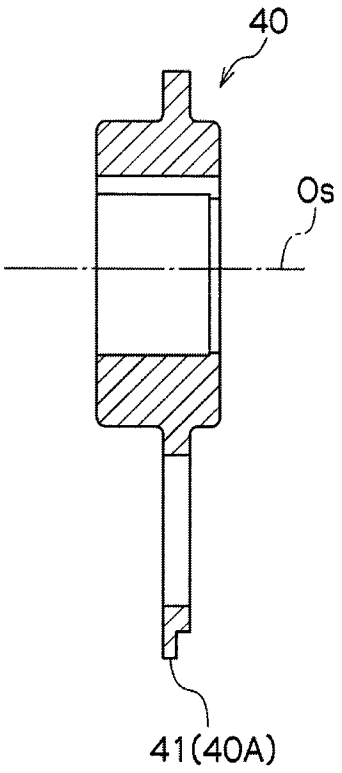
FIG. 7 (*a*) is an explanatory diagram showing a configuration example of an outer tool for performing forming in FIG. 6 (*a*) and FIG. 6 (*b*).
Figure 7A:
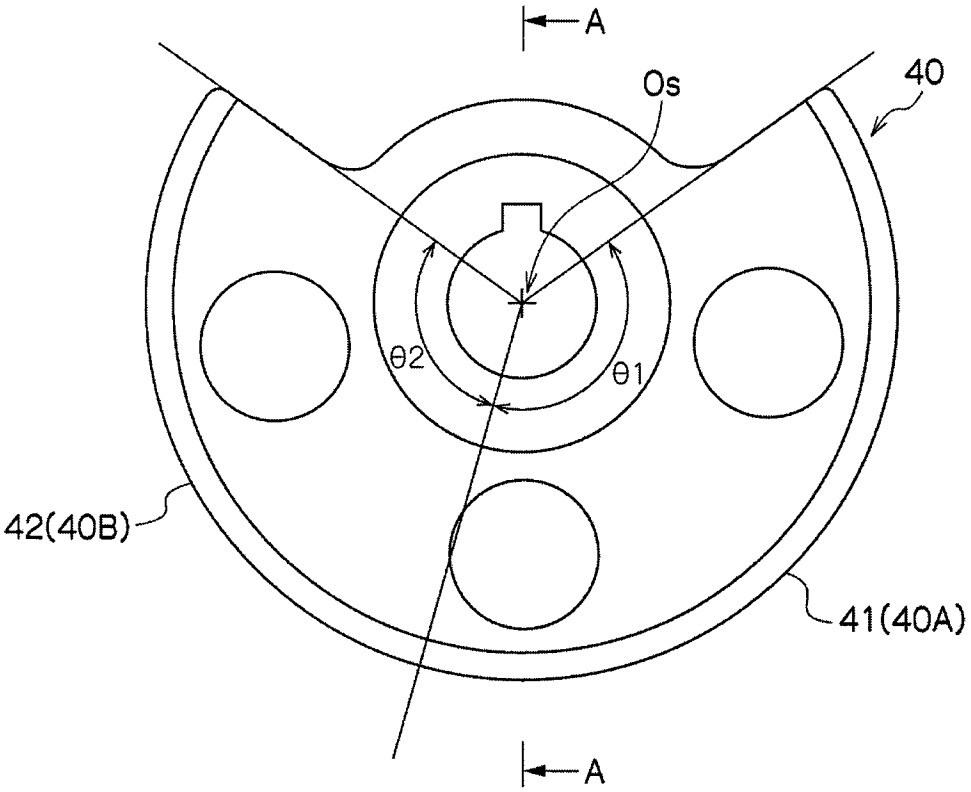

Referring to FIG. 6 (*a*), FIG. 6 (*b*), FIG. 7 (*a*) and FIG. 7 (*b*), a method of forming the curl part in the manufacturing process for the bottle can is described. The curl part 10 is shaped by primarily processing an opening end of the can body into a curl shape by spinning processing and thereafter performing reform processing of the curl part shown in FIG. 6 (*a*) and FIG. 6 (*b*). In the reform processing, an inner tool 30 is disposed on the inner side of the can, and an outer tool 40 disposed on the outer side of the can is pressed against the curl part 10 to form the upper end bent part 11 and the outer wall part 12 of the curl part 10 into desired shapes.

In this case, at a first stage of the reform processing, as shown in FIG. 6 (*a*), the outer tool 40 (40A) having a flat surface 41 along the can axis is pressed against the curl part 10 to perform forming at the first stage, and at a second stage of the reform processing, as shown in FIG. 6 (*b*), the outer tool 40 (40B) having a projection part 42 is pressed against the curl part 10 to adjust the radius of curvature of the upper end bent part 11 and form the first bent part 12A and the second bent part 12B (further, the third bent part 12C and the fourth bent part 12D) of the outer wall part 12.

FIG. 7 (*a*) and FIG. 7 (*b*) show a specific example of the outer tool 40. The outer tool 40 rotates about a rotation axis Os which is parallel to a can axis. During one rotation, forming at the first stage shown in FIG. 6 (*a*) is performed in the range of a first angle θ1 (for example, θ1=120°), and forming at the second stage shown in FIG. 6 (*b*) is performed in the range of a subsequent second angle θ2 (for example, θ2=120°). By using such an outer tool 40, forming processing of the curl part 10 can be efficiently performed without positioning the bead.

While the embodiments of the present invention have been described in detail above with reference to the drawings, the specific configurations are not limited to the embodiments, and the present invention includes design changes in the range not departing from the gist of the present invention. The above-mentioned embodiments can be combined by using respective technologies unless their objects and configuration cause contradictions or problems.

REFERENCE SIGNS LIST

1 Bottle can
1A Bottom part
1B Body part
1C Shoulder part
1D Mouth part
10 Curl part
11 Upper end bent part
11A Inner bent part
11B Outer bent part
12 Outer wall part
12A First bent part
12B Second bent part
12C Third bent part

12D Fourth bent part
12E Lower end face
12F Flat part
12P Lower end inner edge
20 Neck shoulder part
21 Skirt part
22 Screw part
23 Inner tool
40 (40A, 40B) Outer tool
41 Flat surface
42 Projection part

The invention claimed is:

1. A bottle can provided with a curl part at an opening end of a mouth part, wherein the curl part includes an outer wall part extending downward from an upper end bent part, and the outer wall part includes:

a first bent part shaping a locking part that extends continuously and downwardly from the upper end bent part and shapes an outwardly-protruding convex; and a second bent part that extends continuously and downwardly from the first bent part and shapes an inwardly-protruding convex.

2. The bottle can according to claim 1, wherein a bead depth shapes by the first bent part and the second bent part is 0.05 to 0.2 mm.

3. The bottle can according to claim 1, wherein the outer wall part includes:

a third bent part that uses the locking part as a first locking part and shapes a second locking part that shapes an outwardly-protruding convex below the second bent part.

4. The bottle can according to claim 3, comprising a fourth bent part that shapes an outwardly-protruding convex below the third bent part.

5. The bottle can according to claim 3, comprising a flat part between the second bent part and the third bent part.

6. The bottle can according to claim 1, wherein the first bent part has a radius of curvature of 0.5 to 3 mm, and the second bent part has a radius of curvature of 0.5 to 2 mm.

7. The bottle can according to claim 1, wherein the upper end bent part has an inner bent part and an outer bent part, and the inner bent part has a radius of curvature larger than a radius of curvature of the outer bent part.

8. The bottle can according to claim 7, wherein the inner bent part has a radius of curvature of 0.5 to 2 mm, and the outer bent part has a radius of curvature of 0.3 to 0.8 mm.

9. The bottle can according to claim 1, wherein an open angle is provided between a lower end face of the outer wall part and a neck shoulder part.

10. The bottle can according to claim 9, wherein a lower end inner edge of the outer wall part is in contact with the neck shoulder part.

11. A bottle can with a cap, seamed with a cap having a liner material, in which an undercut is shaped so that the locking part in the bottle can according to claim 1 covers the liner material.

12. A method of manufacturing the bottle can according to claim 1, comprising:

pressing an outer tool rotating about a rotation axis parallel to a can axis against a curl part to perform reform processing of the curl part; and pressing, by the outer tool, a flat surface in a range of a first angle (θ1) in one rotation to perform forming at a first stage, and pressing a projection part projecting in a direction orthogonal to a can axis in a range of a subsequent second angle (θ2) to perform forming at a second stage.

13. A method of manufacturing the bottle can according to claim 3, comprising:

pressing an outer tool rotating about a rotation axis parallel to a can axis against a curl part to perform reform processing of the curl part; and pressing, by the outer tool, a flat surface in a range of a first angle (θ1) in one rotation to perform forming at a first stage, and pressing a projection part projecting in a direction orthogonal to a can axis in a range of a subsequent second angle (θ2) to perform forming at a second stage.

14. A method of manufacturing the bottle can according to claim 4, comprising:

pressing an outer tool rotating about a rotation axis parallel to a can axis against a curl part to perform reform processing of the curl part; and pressing, by the outer tool, a flat surface in a range of a first angle (θ1) in one rotation to perform forming at a first stage, and pressing a projection part projecting in a direction orthogonal to a can axis in a range of a subsequent second angle (θ2) to perform forming at a second stage.

15. A method of manufacturing the bottle can according to claim 5, comprising:

pressing an outer tool rotating about a rotation axis parallel to a can axis against a curl part to perform reform processing of the curl part; and pressing, by the outer tool, a flat surface in a range of a first angle (θ1) in one rotation to perform forming at a first stage, and pressing a projection part projecting in a direction orthogonal to a can axis in a range of a subsequent second angle (θ2) to perform forming at a second stage.

16. A method of manufacturing the bottle can according to claim 7, comprising:

pressing an outer tool rotating about a rotation axis parallel to a can axis against a curl part to perform reform processing of the curl part; and pressing, by the outer tool, a flat surface in a range of a first angle (θ1) in one rotation to perform forming at a first stage, and pressing a projection part projecting in a direction orthogonal to a can axis in a range of a subsequent second angle (θ2) to perform forming at a second stage.

17. A method of manufacturing the bottle can according to claim 9, comprising:

pressing an outer tool rotating about a rotation axis parallel to a can axis against a curl part to perform reform processing of the curl part; and pressing, by the outer tool, a flat surface in a range of a first angle (θ1) in one rotation to perform forming at a first stage, and pressing a projection part projecting in a direction orthogonal to a can axis in a range of a subsequent second angle (θ2) to perform forming at a second stage.

18. A method of manufacturing the bottle can according to claim 10, comprising:

pressing an outer tool rotating about a rotation axis parallel to a can axis against a curl part to perform reform processing of the curl part; and pressing, by the outer tool, a flat surface in a range of a first angle (θ1) in one rotation to perform forming at a first stage, and pressing a projection part projecting in a direction orthogonal to a can axis in a range of a subsequent second angle (θ2) to perform forming at a second stage.

* * * * *